United States Patent [19]

Schiller

[11] Patent Number: 4,813,110

[45] **Date of Patent: * Mar. 21, 1989**

[54] SNAP CONNECTOR, LEVER

[76] Inventor: Barry Schiller, 720 N. Flagler Dr., Ft. Lauderdale, Fla. 33304

[ * ] Notice: The portion of the term of this patent subsequent to Sep. 2, 2003 has been disclaimed.

[21] Appl. No.: 856,034

[22] Filed: Jun. 19, 1986

Related U.S. Application Data

[63] Continuation of Ser. No. 680,091, Dec. 10, 1984, Pat. No. 4,608,734.

[51] Int. Cl.[4] ..... A44B 1/28

[52] U.S. Cl. ..... 24/104; 24/90 C; 24/93

[58] Field of Search ..... 24/90 R, 9 C, 93, 94, 24/95, 105, 104, 106, 107, 326

[56] References Cited

U.S. PATENT DOCUMENTS

| | | | |
|---|---|---|---|
| Re. 23,624 | 2/1953 | Sutin | 24/90 R |
| 559,906 | 5/1896 | Platt | 24/90 R |
| 1,270,494 | 6/1918 | Christiansen | 24/93 |
| 1,633,616 | 6/1927 | Sokol | 24/326 |
| 1,690,129 | 11/1928 | Prentiss | 24/90 R |
| 2,548,004 | 4/1951 | Duefrene | 24/90 C |
| 3,360,835 | 1/1968 | Foertmeyer | 24/90 R |
| 3,623,192 | 11/1971 | Papazian | 24/90 R |
| 3,735,447 | 5/1973 | Abraham | 24/90 R |
| 4,194,272 | 3/1980 | Taffurelli | 24/90 R |

FOREIGN PATENT DOCUMENTS

| | | | |
|---|---|---|---|
| 1266347 | 5/1961 | France | 24/104 |

*Primary Examiner*—Victor N. Sakran

*Attorney, Agent, or Firm*—Malin, Haley & McHale

[57] ABSTRACT

A snap connector lever for mating threadless buttons or fasteners for securing overlapping sections of materials such as garments such as men's shirts or women's blouses that are usually secured by buttons. The snap connector lever may be a replacement for a button which has been detached from the garment. The snap connector lever includes complimentary elements of the male and female parts of the threadless fastener or button with one lever for facilitating quick separation of the elements that is attached to the female part but may be attached to the male part.

1 Claim, 2 Drawing Sheets

SNAP CONNECTOR, LEVER

This application is a continuation of application Ser. No. 680,091, filed Dec. 10, 1984, now U.S. Pat. No. 4,608,734.

BACKGROUND OF THE INVENTION

1. Field of the Invention

This invention relates to improved mating threadless buttons or fasteners for securing overlapping sections of materials such as garments, men's shirts or women's blouses, usually secured by buttons or as an interim replacement for a button which has been detached from the garment.

2. Description of the Prior Art

In the past, a user would pull on the overlapping material in a garment adjacent the threadless buttons or fasteners to separate the mating threadless buttons or fasteners. Such action would tear the material of the garment around the threadless buttons or fasteners.

The prior art U.S. Patent to Foertmeyer, U.S. Pat. No. 3,360,835 discloses a two-piece threadless button including socket and pin elements wherein the pin element is permanently lockable in the socket element.

U.S. Patent to Sokol, U.S. Pat. No. 1,633,616 discloses a barrette including a pair of separate complimentary strips detachably secured to each other by snap fasteners wherein the male or head section of the fastener is mounted on one strip and the female or socket section is mounted on the other strip.

The U.S. Patent to Abraham, U.S. Pat. No. 3,735,447 discloses a device for holding an object, e.g. a corsage, to a garment wherein the device comprises a pair of elements detachably secured to each other by pins secured to one element functionally engaged in passageways or throughbores.

SUMMARY OF THE INVENTION

One object of the invention is an improved threadless button or fastener or clamping device including means for facilitating quick separation of the elements of the device thereby preventing damage to garments upon removal therefrom.

Another object of the invention is the use of a snap fastener for securing detachable sections of a garment wherein the male and female elements of the snap fastener are removably secured to the different sections of the garment, respectively.

A further object is to provide a non-complex means for attaching threadless buttons or fasteners to a garment to replace other fasteners.

Still another object of the invention is in the simplistic construction of the threadless button which permits rapid manufacture at low cost thereof.

Other objects of the invention will be readily apparent to those skilled in the art in light of the following description and accompanying drawing.

DETAILED DESCRIPTION OF THE INVENTION

Figure 1:
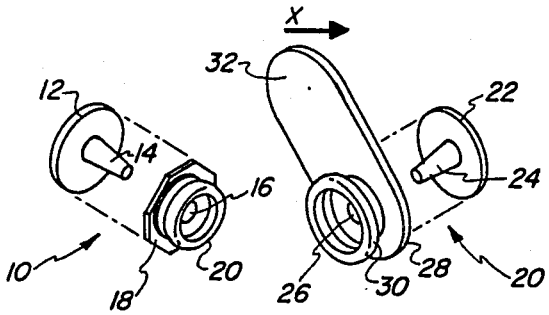
FIG. 1 illustrates exploded perspective views of each of the complementary elements of the male and female parts of the threadless fastener or button with one means for facilitating quick separation of the elements that is attached to the female part but may be attached to the male part.

Referring now in detail to the drawing, FIG. 1 illustrates a first embodiment of the threadless button. Numerals 10 and 20 designate generally the male and female mating threadless fastener assemblies respectively, with complementary components of the button. The male and female elements of the button are each removably and detachably secured to different sections of a garment by straight tapered pins 14, 24 that are passed through the garment. The tapered pins 14 and 24 are circular in cross-section and permanently secured to bases 12, 22 respectively, which frictionally engage through holes or apertures 16, 26 in the other bases 18, 28 having male 20 and female 30 snap-fastener elements permanently secured to other bases 18, 28. The axis of the apertures 16 and 26 and the axis of the male and female elements are aligned. The length of pins 14, 24 are of a length sufficient to frictionally engage the through hole for frictionally securing bases 12, 18 and 22, 28 without accidental detachment and yet not interfering with coupling of male and female elements 20, 30. The distal ends of pins 14, 24 may also be pressed down and permenantly enlarged the ends as shown in FIG. 2B at 14', 24' to permenantly fix all the component parts to the material 11 and 13 that is positioned between base 12 and other base 18 as well as between base 22 and other base 28. The base 28 of the female coupling element includes an integral extension 32 which facilitates quick release and disengagement of the female element 30 from the male element 20. When the extension 32 is manually depressed in the direction of arrow X, away from the male element 20, it acts as a lever element to open the snap and to prevent strain on the material of a garment around the coupling element.

The various elements of modifications as illustrated in FIGS. 2A, 2B, 3, 4 and 5 are identical to those shown in FIG. 1 are designated by the same reference numeral and where different are indicated by a prime.

Figure 2A:
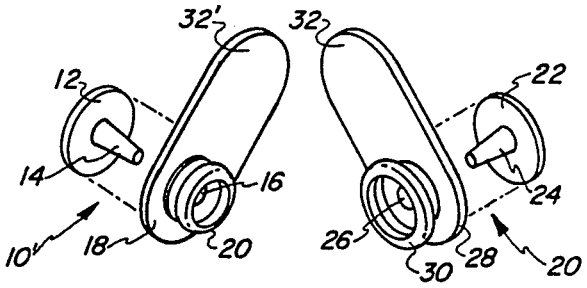
FIG. 2A illustrates an exploded perspective view of a first modification of the invention of FIG. 1 with two adjacent means for facilitating quick separation of the elements.
Figure 2B:
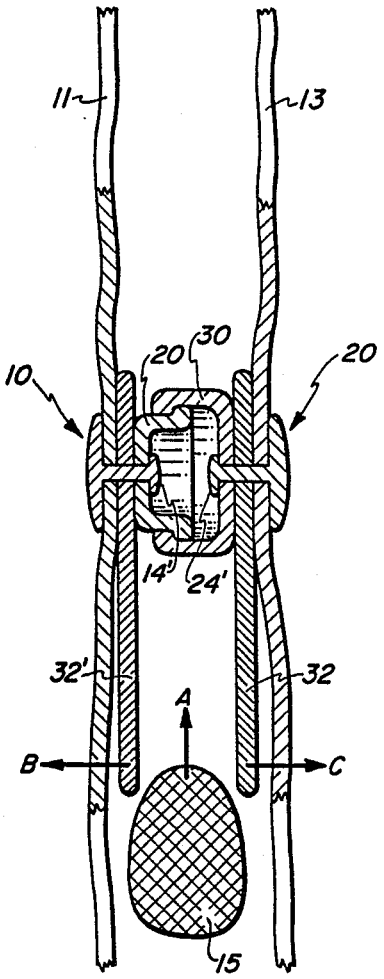
FIG. 2B illustrates the threadless fasteners shown in FIG. 2A connected to two pieces of material and connected together to illustrate a finger moving up between the two quick release element means.

Referring now to FIG. 2A that illustrates a second embodiment of the invention, which is identical to the first embodement except that other base 18 of male element 10' includes an extension 32' similar to extension 32 of female element 20. The extension 32' functions and is utilized like the extension 32 thereby permitting manual movement to further aid in quicker release of the male and female elements 10' and 20. The extensions 32 and 32' allows a user to run his finger 15 shown in FIG. 2B in the direction of arrow A to move extension 32 in the direction of arrow C and to move extension 32' in the direction of arrow B. As the finger 15 moves between extensions 32 and 32' the extensions are moved apart to aid in quick release of elements 10' and 20.

Figure 3:
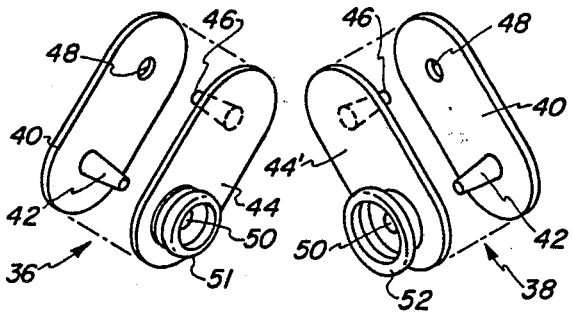
FIG. 3 illustrates an exploded perspective view and still another modification.

Referring to FIG. 3 illustrates a third embodiment of a threadless button. Numerals 36, 38 designated generally the male and female complementary components of the threadless fastener or button, respectively, which are removable and detachably secured to different sections of a garment by straight tapered pins 42, 46 secured to bases 40, 44, 44' and removably engageable in holes 48, 50 in bases 44, 44' having thereon male 51 and female 52 elements of the snap fastener. The pins, holes, bases of FIG. 3 are of the same construction as like elements of FIG. 1 described above. This construction permits a more permanent attachment to a garment and by relegation of a plurality of pins decreases any possibility of damage to a garment to which the male and female members are attached. The extended bases that are positioned on both sides of the garment material prevent extensions 44 and 44' from moving away from the garment material. A user may run his finger in one direction between members 44 and 44' to aid in quick release of elements.

Figure 4:
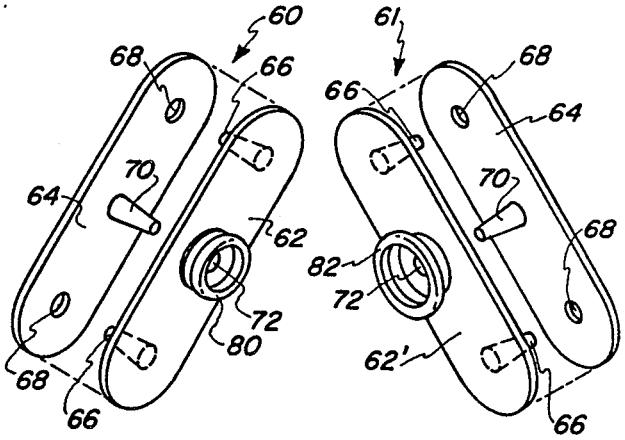
FIG. 4 illustrates an exploded perspective different embodiment of the invention of FIG. 3.

FIG. 4 shows a modification of FIG. 3 and designates male and female complementary components 60, 61 including bases 62, 62', 64, tapered pins 66, 70, through holes 68, 72 and male 80 and female 82 elements, wherein each of the above elements are of the same construction as like elements as described in FIGS. 1 through 3, except the extensions 62, 62' and 64 project outward in two directions from the elements 80 and 82. A user may run his finger in two directions, either up or down, along the opening of a shirt where the longitudinal length of the bases 62 and 62' lie. The base extensions lie parallel to the opening of the garment to aid in quick release of the elements 80 and 82.

Figure 5:
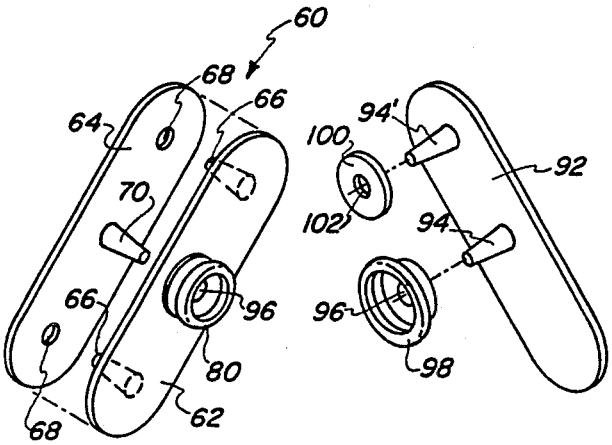
FIG. 5 illustrates an exploded perspective embodiment of an additional modification.

Now referring to FIG. 5, a modification of FIG. 4, wherein the element generally indicated by reference numeral 60 is identical to that member identified by numeral 60 in FIG. 4. Male element 80 is removably secured to a female member generally indicated by reference numeral 98. The female element 98 includes a base 92 projecting outward in two directions having secured thereto at least two pins or prongs 94, 94', similar in construction to pins 66. The female element 98 of the snap fastener is secured to pin 94. Additional connector element 100 having an aperture 102 engages pin 94' to further maintain base 92 in engagement with a portion of a garment that will lie between base 92 and connector element 100.

Figure 6:
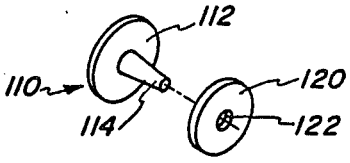
FIG. 6 illustrates a portion of the invention for attaching the connectors to material.

FIG. 6 illustrates a modification wherein in lieu of a base having thereon a plurality of pins, the opposes side 112 of the element 110 has the tapered pin 114 secured thereto, which pin is frictionally removably engageable in aperture 122 of washer-like element 120 for securing a male or female element (not shown) to a portion of a garment. The male or female element of a snap fastener may be connected to the washer 120 by any well known means.

The various inventions as depicted in the figures are utilized by, for example, as buttons for a men's shirt in lieu of the usual buttons or as a substitute for a lost button by first forcing by manual pressure the pins of the male and female members through the longitudinal opposed edges respectively of the front opening if a shirt and then through the throughbores whereby the male and female members are tightly secured to the shirt. Thereafter, the male and female elements which may be a snap fastener are detachably secured together thereby connecting the opposed longitudinal edges of the shirt.

The manner of utilizing snap fasteners is well-known in the prior art as evidenced by the patent to Sokol as is the use of pins engagable in through holes as taught in the patents to Foertmeyer and Abraham.

The compositions disclosed in the cited is prior art may be utilized in the fabrication of the various elements and members of the described threadless button and are herein incorporated by reference.

It is evident from the above disclosure that departures may be made therefrom without deviating from the spirit of the invention and without sacrificing from the principle advantages thereof.

What is claimed is:

1. A quick attaching threadless fastener with a quick release means for connecting two pieces of material to prevent tearing or damage to the material comprising:

a first mating threadless fastener assembly including a first base and a first threadless fastener one of which is placed on each side of the first piece of material;

said first threadless fastener assembly including a first intermediate member connected to said first base, said first intermediate member having a distant end connectable to said first threadless fastener, after said first intermediate member passes partially through said first piece of material the entire said first threadless fastener assembly is connected together;

a second mating threadless fastener assembly including a second base and a second threadless fastener matably connectable to said first threadless fastener one of which is placed on each side of the second piece of material;

said second threadless fastener assembly including a second intermediate member connectable to said second base, said second intermediate member having a distant end connectable to said second threadless fastener after said second intermediate member passes partially through said second piece of material the entire such second threadless fastener assembly is connected together; and a first quick release element means connected to and adjacent to said second mating threadless fastener and on the same side of the second piece of material, said first quick release element means for canterlevering said second mating threadless fastener assembly away from said first mating threadless fastener assembly for unmating said second threadless fastener from said first threadless fastener.

* * * * *